US008191619B2

(12) United States Patent
Orban

(10) Patent No.: US 8,191,619 B2
(45) Date of Patent: Jun. 5, 2012

(54) DOWNHOLE SYSTEM AND AN IMMERSION HYDRAULIC MACHINE FOR EXTRACTION OF FLUIDS

(75) Inventor: Jacques Orban, Moscow (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 244 days.

(21) Appl. No.: 12/293,674

(22) PCT Filed: Mar. 16, 2007

(86) PCT No.: PCT/RU2007/000133

§ 371 (c)(1),
(2), (4) Date: Oct. 20, 2008

(87) PCT Pub. No.: WO2007/108722

PCT Pub. Date: Sep. 27, 2007

(65) Prior Publication Data

US 2010/0230089 A1 Sep. 16, 2010

(30) Foreign Application Priority Data

Mar. 21, 2006 (RU) ..... 2006108988

(51) Int. Cl.
*E21B 43/14* (2006.01)

(52) U.S. Cl. ..... 166/54.1; 166/369

(58) Field of Classification Search ..... 166/54.1, 166/268, 313, 369, 50; 417/46, 47, 219, 417/220

See application file for complete search history.

(56) References Cited

U.S. PATENT DOCUMENTS

| | | | | |
|---|---|---|---|---|
| 4,259,039 | A * | 3/1981 | Arnold | 417/220 |
| 5,335,732 | A * | 8/1994 | McIntyre | 166/313 |
| 6,119,780 | A * | 9/2000 | Christmas | 166/313 |
| 6,913,446 | B2 * | 7/2005 | Nissen et al. | 417/53 |

FOREIGN PATENT DOCUMENTS

| | | | |
|---|---|---|---|
| RU | 2162965 | C2 | 2/2001 |
| RU | 2183769 | C1 | 6/2002 |
| RU | 2191926 | C2 | 10/2002 |
| RU | 2003134142 | A | 5/2005 |

* cited by examiner

*Primary Examiner* — Brad Harcourt
(74) *Attorney, Agent, or Firm* — Jim D. Patterson

(57) ABSTRACT

The claimed invention relates to the downhole systems for extracting various fluids, in particular—for simultaneous extraction out of a number of producing formations. The inventive downhole system comprises a casing pipe and a tubing extending through said casing pipe, between which pipe and tubing formed are separate isolated cavities. Each one of which cavities communicates, via perforations, with a respective producing formation. In each one of the isolated cavities, to the tubing coupled is a hydraulic machine comprised by a motor and pump. The hydraulic machines in different isolated cavities being adapted to be adjusted independently. This system permits simultaneous extraction of fluids out of different producing formations, with independent controlling of such extraction in various formations. The claimed invention also relates to an immersion hydraulic machine used for extracting fluids.

16 Claims, 6 Drawing Sheets

DOWNHOLE SYSTEM AND AN IMMERSION HYDRAULIC MACHINE FOR EXTRACTION OF FLUIDS

TECHNICAL FIELD

The invention relates to a downhole system for extracting the fluids, in particular—for simultaneous extraction from different producing formations. The invention further relates to an immersion hydraulic machine for extracting the fluids.

BACKGROUND

As operation of an oil well proceeds, a technique used for extraction of petroleum changes in the course of time. In most cases, extraction in its beginning is carried out owing to the natural pressure existing in a producing formation (flowing well operation mode). With the passage of time, the formation pressure falls, and for this reason the equipment for mechanised extraction of petroleum must be applied.

Presently, production of petroleum can be carried out by successive development of separate producing formations, if a given well intersects a number of beds eventually suitable for petroleum production. A disadvantage of this technique consists in that when the change-over from one formation to another takes place, a considerable amount of time has to be spent, and additional expenses are needed to re-adjust the equipment. Furthermore, as a given producing formation is developed, the extracted petroleum volume may diminish, which results in a significant decrease in productive capacity of a well. Under these circumstances, continuation of extraction of petroleum out of this formation may cause lowering of cost-effectiveness of a well, and the change-over to development of a subsequent formation results in incomplete exhaustion of this previous formation. Another disadvantage of such successive development consists in that, due to absence of data on extraction from other formations, productive capacity of a given well and, consequently, economic advisability of development of a given well is hard to be forecast.

It should be further noted that the equipment used at the stage of flowing well operation, and the equipment used for the mechanised production must be different. For this reason, when a petroleum extraction technique is changed, the flowing-well equipment if lifted and replaced with that for the mechanised petroleum extraction. Such replacement of equipment requires a considerable time and represents a rather expensive operation, especially for offshore wells.

Another extraction technique is a mixed extraction out of different formations in the form of single flow, and pumping-out of the same using one downhole pump. When this technique is used, monitoring of origin of the extracted fluids is not possible. Productive capacity of each one of formations depends on such different parameters as pressure, viscosity of fluids, throughput capacity of each one of the formations. In other cases, a formation may start producing too much water or gas. But it is not possible to determine which one of the formations produces these undesirable fluids. Proper monitoring of the formation-by-formation productive capacity is also impossible.

In the mechanised petroleum extraction, the electric immersion pumps have been used most extensively. However, these pumps have some drawbacks:

- fast wear of parts due to high rotational speeds and the effects exerted by hard particles contained in the extracted fluid;
- poor operation with a gas that restricts capacity of a pump and can even cause failure thereof;

- a great length of these pumps makes mounting thereof more difficult and increases the accompanying expenses;
- a greater mass of these pumps causes them to be more sluggish;
- supply of a fluid through a pump cannot be determined, for such possibility depends on a number of parameters of a given fluid;
- a low reliability due to high rotational speed and a considerable mass, and also for the reason that the pump motor has high voltage and there is a strong current in oil, which circumstances may cause a motor to fail.

In view of the matters discussed above, one of the goals this invention is directed at, is development of a downhole system for extracting the fluids, which system will allow simultaneous extraction of petroleum out of a number of producing formations, the feature of controlling extraction out of each one of formations being provided. The other goal consists in provision of an immersion hydraulic machine for extraction of fluids, which machine will avoid disadvantages of the electric immersion pumps, allow controlling of extraction, and will be suitable for operation both in the flowing well operation mode and the mechanised extraction mode.

This goal is to be attained using a downhole system for extracting the fluids, comprising: a casing pipe and a tubing extending therethrough, between which pipe and tubing formed are separate isolated cavities, each one of them communicating, via perforations, with a corresponding formation; in each one of the isolated cavities, to the tubing coupled is a hydraulic machine comprised by a motor and pump; the hydraulic machines in different isolated cavities being adapted to be controlled independently.

This feature of coordinating a respective hydraulic machine with each one of the producing formations allows develop several producing formations concurrently, and owing to independent controlling of each one of the hydraulic machines—said formations can be developed independently of one another, and with an extraction volume desirable for each one of the formations.

Independent controlling of a respective hydraulic machine can be preferably effected by a separate control unit. A control unit is able to control both supply for motor of a respective hydraulic machine and output of this motor.

Adjustment of the motor supply can be done by changing of the shaft rotational speed. In case a motor is the electric motor, then rotational speed of its shaft can be adjusted using the control unit by changing the supply current frequency, strength of current, voltage, etc. A method for adjusting the speed depends on a motor type, for example: changing of frequency is most frequently used to adjust the three-phase alternating current electric motors, while adjustment of the input voltage is more used to control speed of the direct current electric motors. Means and methods for such adjustment of electric motors are generally known in prior art, and are not described here in more detail. If a number of motors is positioned in one well, then required is the independent controlling, which can be done by provision of independent cables for each motor from the surface. If a motor is the hydraulic motor, then the shaft rotational speed can be adjusted using the control unit by changing a quantity, rate, etc. of the working fluid supplied to the motor.

To carry out said adjustment of the hydraulic motor, the control unit can comprise a controlled throttle and/or permanent throttle, etc. positioned on the hydraulic motor hydraulic line. In the simplest case, the control unit is either a permanent throttle or controlled throttle. The controlled throttles and methods for adjusting the same are generally known in prior art, and are not described here in more detail. These throttles increase the pressure drop in the flow going towards that motor. This pressure increase provides advantage for the flow towards another motor.

A hydraulic machine motor can be implemented in the form of a hydraulic motor wherein the drive shaft is disposed eccentrically with respect to the housing of that hydraulic motor. In this case it may be preferable to adjust volume of a hydraulic motor by adjusting a value of eccentricity. In this case the control unit includes the assembly of rod-hydraulic cylinder, gearing assembly {e.g. rack-gears, etc.), or a similar means adapted to exert action on the motor shaft for changing its eccentricity with respect to the motor housing.

SUMMARY

In an embodiment, motors can be supplied via a separate supply line for each motor. This allows controlling of each motor by its own control unit that is preferably positioned on the surface. This positioning of the control unit on the surface allows use the inner well space more optimally, and also allows use any adjusting equipment, without the need to take into consideration the dimensions of such equipment. Or in some cases, each control unit can be fitted in a respective motor. This arrangement can simplify mounting of the downhole equipment, because the control unit can be combined with the motor by manufacturer in the course of assembling of the whole hydraulic machine. Apart from that simple mounting, this mounting saves time for carrying out the same, for the necessity to do such mounting of the motor-adjusting equipment on the surface is avoided.

According to another embodiment of the invention, the supply can be adjusted through single supply line for all hydraulic machines. In this embodiment, each motor has a respective control unit installed therein. Advantages of this embodiment are described above with reference to the version of the single supply line.

It is obvious that the supply line {being both the single line common for all motors, and separate lines for each motor), if in the hydraulic machines used are the electric motors, will be an electric cable; and if in the hydraulic machines used are the hydraulic motors, said supply line will be the hydraulic supply line. It should be noted that both in the case of the single supply line, and in case of separate supply lines for each motor: the control unit in its motor for adjusting the same can be provided with a special control line extending from the surface. Other versions suitable to serve that purpose are possible as well.

A person skilled in the art will appreciate that these versions for adjusting hydraulic motors of hydraulic, machines are equally suitable for adjustment of pumps of hydraulic machines. It should be also appreciated that the adjustment means described herein for adjusting the hydraulic motors are equally suitable for pumps as well.

In a hydraulic machine, its pump and motor can be mounted both on the common shaft, and on their separate shafts. Separate shafts can be interconnected using an engagement means. Such engagement means may include, for example, at least one engagement (coupling) that can be of the frictional, hydraulic, mechanical types, or similar types. In such case, a hydraulic machine can be adjusted using adjustment of said engagement means. Adjustment of engagement (coupling) is generally known in prior art, and is not further explained here.

A positive-displacement rotary unit is preferably used as the hydraulic machine pump. In this case, the flow delivered by such pump does not depend on pressure existing in the tubing, so that erosion of the system, that takes place in use of an electric immersion pump, is not the case here. A rotary positive-displacement pump, owing to said adjustment, operates at a predetermined speed, which allows determine the total supply provided by each pump. Further, a pump can be equipped with a sensor to adjust its output. This pump's sensor is able to provide data on flow speed and quantity of extracted petroleum, such that accuracy of measurement of the supply provided by each pump is additionally improved. Apart from the data on speed and volume of the flow, this pump sensor is adapted to provide data on composition of the extracted petroleum. The data on composition can represent both the precise composition of extracted petroleum and content of its constituents, for example—content of water, gas, etc. The pump sensor also can provide data only on some of these parameters. As such sensors, the following devices can be suitably used: Schlumberger Flow-Watcher/Flow Tester, Rosemount 405, Daniel 1500, Cole-PARMER (IE EW-32715-16), Krone-mar ALTOSONIC, EESIFLO EASZ-3000, Schlumberger PSP, EXPRO-Group, etc.).

Measurement of the flow going through each pump allows pre-set the optimal adjustment of each pump. This circumstance is particularly important when an impeller (guided-vane) pump is used. In this type of pumps, the correct ratio of flow speed and delivery pressure is difficult to maintain. Thus, if a number of pumps deliver the extracted fluid into the same tubing, then operation of a pump will be quite sensitive to a definite performance of each pump. In the worst case, one pump may get stuck in case of an insignificant difference between its output and that of any other pump.

In a hydraulic machine, possible use of a positive-displacement rotary unit both as a pump and a motor, in particular a hydraulic motor, is preferable. In this case, a pump and motor can be mutually complementary, i.e. they are capable of performing the functions of both a motor and pump. In the ordinary mode of operation: the working fluid is supplied from the surface into a motor via an hydraulic line. The working fluid can be a degassed sand-free petroleum, oil, etc. The working fluid drives a motor that in its turn drives a pump. The pump begins the suction of petroleum out of a producing formation and delivery of the same into the tubing. Such operation of the hydraulic machine is carried out at the stage of the mechanised extraction of petroleum. In case of the flowing well operation, this hydraulic machine functions as a flow-control system of the in-depth valve type. The presence of natural pressure in a producing formation is conducive to delivery of petroleum into a pump, which pump begins to function as a motor. Consequently, the pump drives the motor that sucks the working fluid from the surface via an auxiliary line, and delivers the same into the hydraulic line. By throttling this flow, e.g. by a throttle positioned on the hydraulic line, the motor is able to "brake" or decelerate the pump for the purpose to decrease productive capacity of this formation to a required level. In such case, the throttle should be preferably positioned on the motor's delivery line, such that the fluid will be sucked by the braking machine through the hydraulic line, and then the fluid will pass through the adjusting throttle; this arrangement would eliminate any possible cavitation effect by restricting a pressure loss in the system's suction portion. In some cases, the extracted flow of petroleum out of a given producing formation can be blocked even completely, for example—using the surface equipment that delivers the working fluid through the auxiliary line. Thus, such design of the hydraulic machine allows use it both at the flowing well operation stage and at the mechanised operation stage, which is an essential advantage of the inventive downhole system. Hence, this arrangement considerably improves cost-effectiveness, because there will not by any expenses for replacement of equipment when one extraction technique is changed over to another one, and then any additional time will not be spent for such replacement. Furthermore, use of a clear liquid from the surface, not the extracted liquid (petroleum) having hard particles (sand), as the throttling liquid will extend longevity of the system due to elimination of any erosion.

In another embodiment, the auxiliary line may be excluded, if, for example, the claimed downhole system is used for the mechanised extraction of petroleum. When the auxiliary line is absent, then the working fluid, that has passed through the motor, commingles with the extracted petroleum and returns to the surface along the tubing. Or the working fluid can be delivered by the motor downwards through the annular clearance between the tubing and casing pipe, and then be returned to the surface along the tubing, when the pump operates.

Additional advantage of implementation of the hydraulic machine as comprising two positive-displacement rotary units (a pump and motor) consists in that at least a portion of the working fluid, that has been discharged by the motor, can be supplied to the pump. Such supply can be done via a separate pipeline between the motor and pump, or through a channel (opening) therebetween. Both in said separate pipeline, and in said channel: a valve, preferably a one-way valve, or similar means, can be used to prevent the reverse flow from the pump into motor. Thus, the interior of the pump always has an excessive amount of fluid that precludes the gas from any action that may prevent suction, or restricts formation of any clearance volume within the pump, which clearance impairs output of the pump. This circumstance is of a particular advantage when the extracted petroleum has an high content of gases.

As said positive-displacement rotary pump/motor: an impeller (guided-vane) pump, screw pump, labyrinth pump, or similar pump, as well as their various modifications, can be used. One of the modifications is a rotary pump having deformable rollers, which pump is a modification of an impeller (guided-vane) pump. Such rotary pump having deformable rollers includes:

an hollow housing, comprising a side wall and end-face walls;

a shaft rotatably positioned within the housing, the distance between the side wall of the housing and the shaft being variable;

deformable rollers disposed and moveable, as the shaft rotates, between the housing side wall and the shaft while being subjected to maximum deformation in the region of the minimum distance between the housing side wall and the shaft; and sealed cavities, each of which cavities being defined by two contiguous rollers, the housing's side wall and end-face walls and the shaft; said sealed cavities communicating with the suction port as their volume increases, and communicating with the delivery port as their volume decreases.

This pump has minor dimensions and lesser mass, and has no parts that would rotate at an high speed, and displaces the extracted fluid by separate volumes, so that when this pump is used, the problems intrinsic to the use of the electric immersion pumps are eliminated. Further, in this rotary pump, any reverse flows are avoided, which circumstance significantly improves output of this pump.

Another objective of the invention is accomplished using an immersion hydraulic machine intended for extraction of fluids and comprising:

a first working unit in the form of a rotary positive-displacement unit that has the suction port communicating with environment, and the delivery port to communicate with a tubing; and a second working unit coupled to the first working unit and having the inlet and outlet ports used for connecting a supply hydraulic line of working fluid of this unit;

each one of said units is adapted to work in the mode of a hydraulic motor to drive the respective other said unit for operating the same in the pumping mode;

the first unit being adapted to direct the extracted fluid flow out of the suction port into the delivery port irrespective of a mode of its operation.

BRIEF DESCRIPTION OF THE FIGURES

An exemplary embodiment of the claimed invention is further described in detail, with reference to the accompanying drawings wherein:

DETAILED DESCRIPTION

Figure 1:
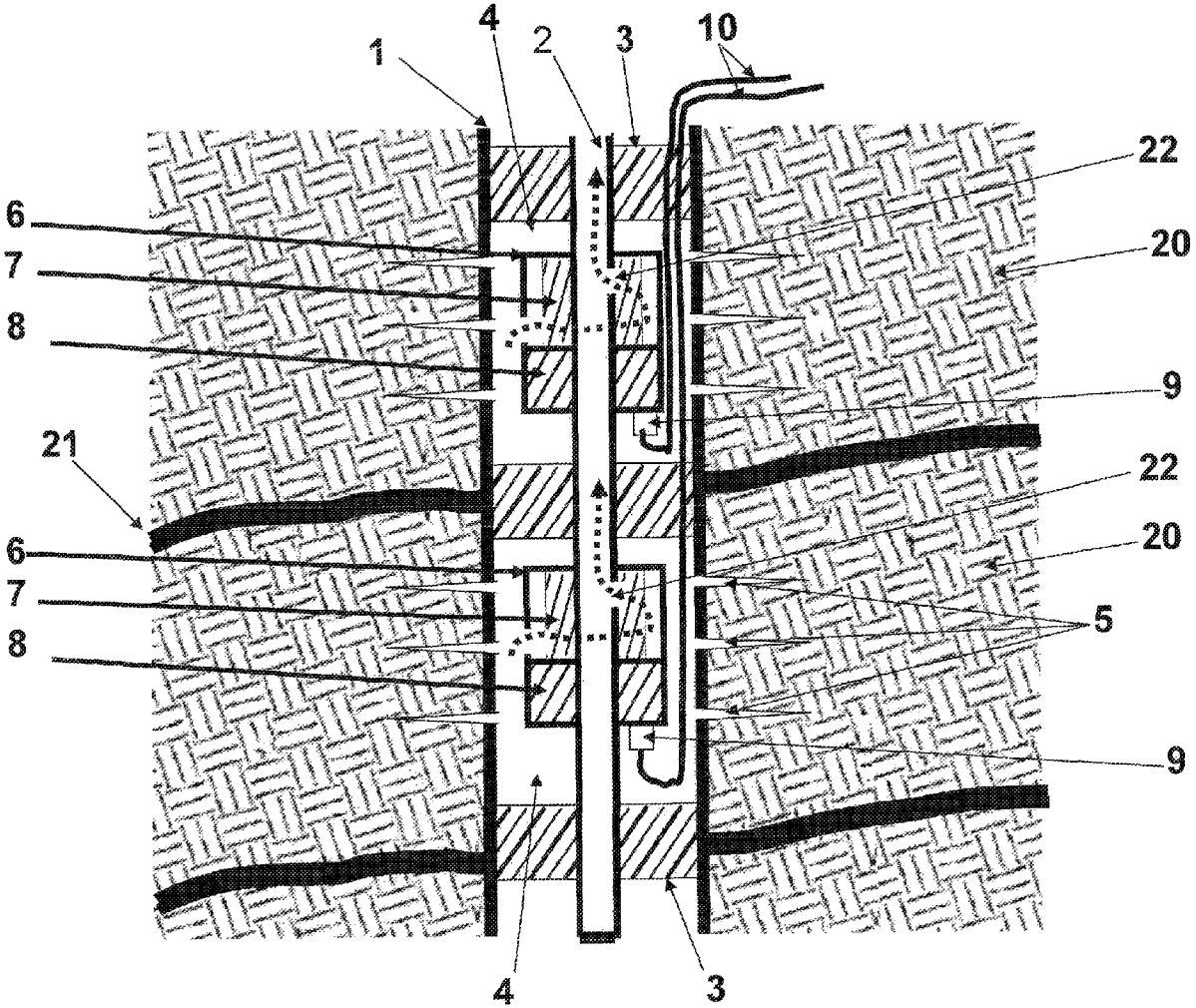
FIG. 1—a downhole system comprising a number of hydraulic machines.
Figure 2:
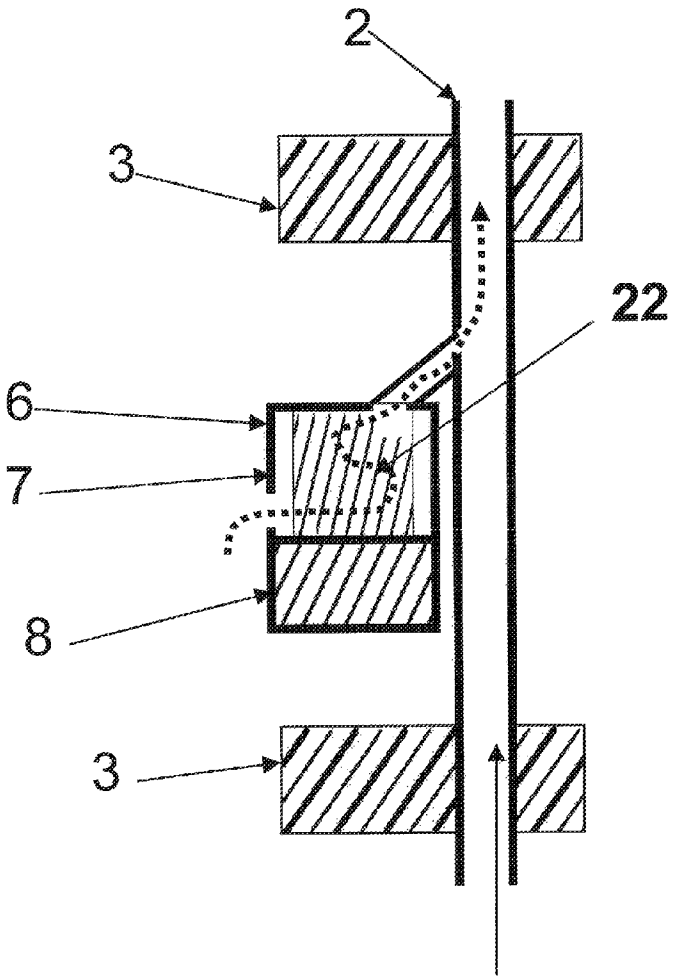
FIG. 2—an hydraulic machine with the lateral disposition of a tubing.
Figure 3:
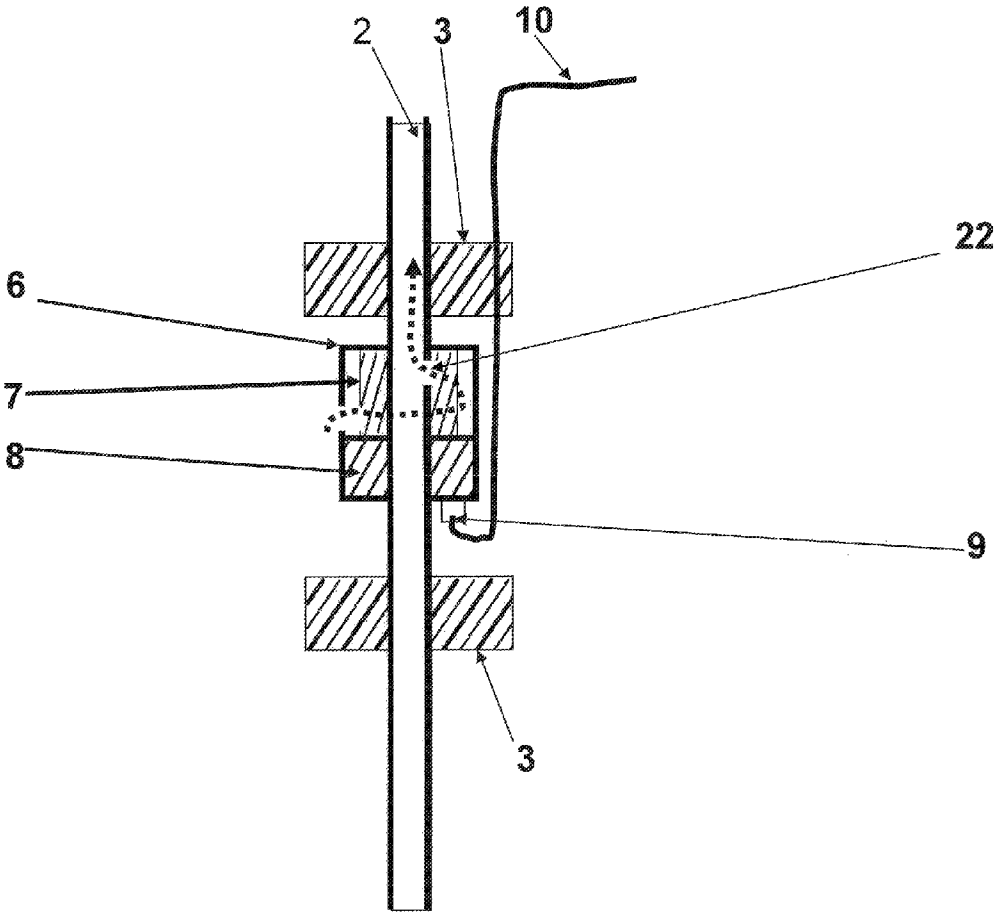
FIG. 3—a hydraulic machine with the central disposition of a tubing.

FIG. 1 shows the inventive downhole system. This downhole system comprises casing pipe 1. Tubing 2 extends through casing pipe 1. Between casing pipe 1 and tubing 2 installed are packers 3 that within the well form separate isolated cavities 4 connected to a producing formation. Connection of these isolated cavities 4 with a corresponding producing formation is effected by perforations 5 in casing pipe 1. In each one of isolated cavities 4, to tubing 2 connected is hydraulic machine 6. Tubing 2 may have the lateral—with respect to the central longitudinal axis of casing pipe 1—disposition (FIG. 2). Or tubing 2 can be positioned to extend through centre. In such case, hydraulic machine 6 preferably is designed in the "annular" configuration (FIG. 3), because this design allows a better use of the well cross-section in terms of output of the pump. In both cases, a number of hydraulic machines 6 may be provided for. Some producing formations 20 are separated one from another by natural isolating layers 21.

Hydraulic machine 6 consists of two working units, which are: pump 7 as the first working unit, and hydraulic motor 8 as the second working unit, and these working units in this embodiment are mounted on the single common shaft. Pump 7 has at least one delivery port communicating with tubing 2, and at least one suction port communicating with isolated cavity 4 around hydraulic machine 6. This embodiment provides for the single supplying hydraulic line that supplies the working fluid for each hydraulic machine's motor. Said supplying hydraulic line, that supplies the working fluid to the motor, comprises hydraulic line 10 and an auxiliary line (not shown), each one of the lines communicating with a respective opening in a respective motor, and with its own or common tanks positioned on the surface. In certain cases, the auxiliary line may be omitted; for example—if the hydraulic machine is used only at the stage of the mechanised extraction. Motor 8 is equipped with control unit 9 that controls the working fluid flow entering motor 8 from the surface via hydraulic line 10. Controlling of this flow in its turn permits to adjust the supply from respective pump 7. Once the working fluid has passed through motor 8, it is sent, via the auxiliary line (not shown), to the surface. The fluid out of the formation is pumped by the pump from cavity 4 and delivered into the tubing along route 22.

Figure 4:
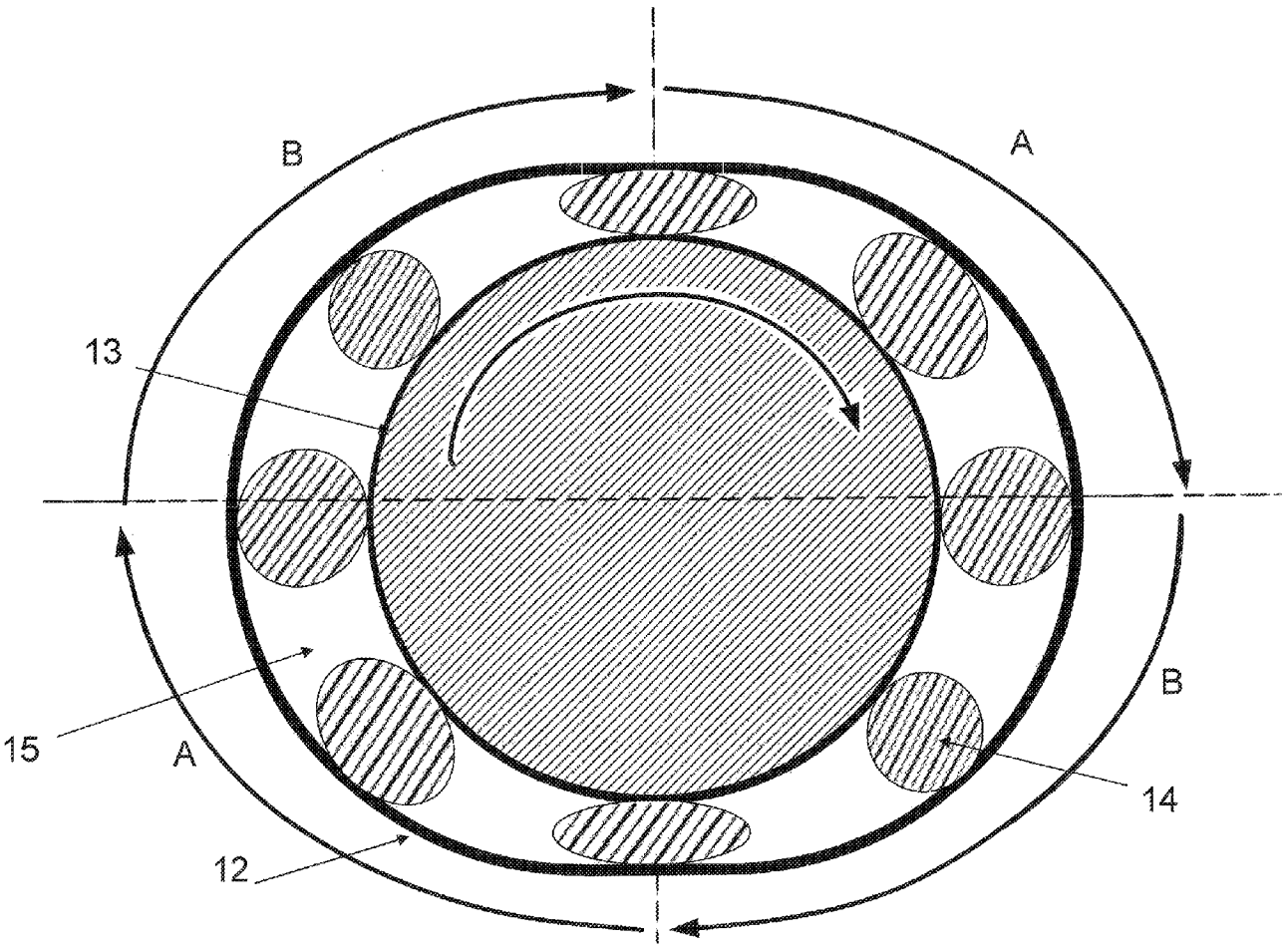
FIG. 4—cross-section of a positive-displacement of rotary pump having deformable rollers according to an embodiment of the invention.
Figure 5:
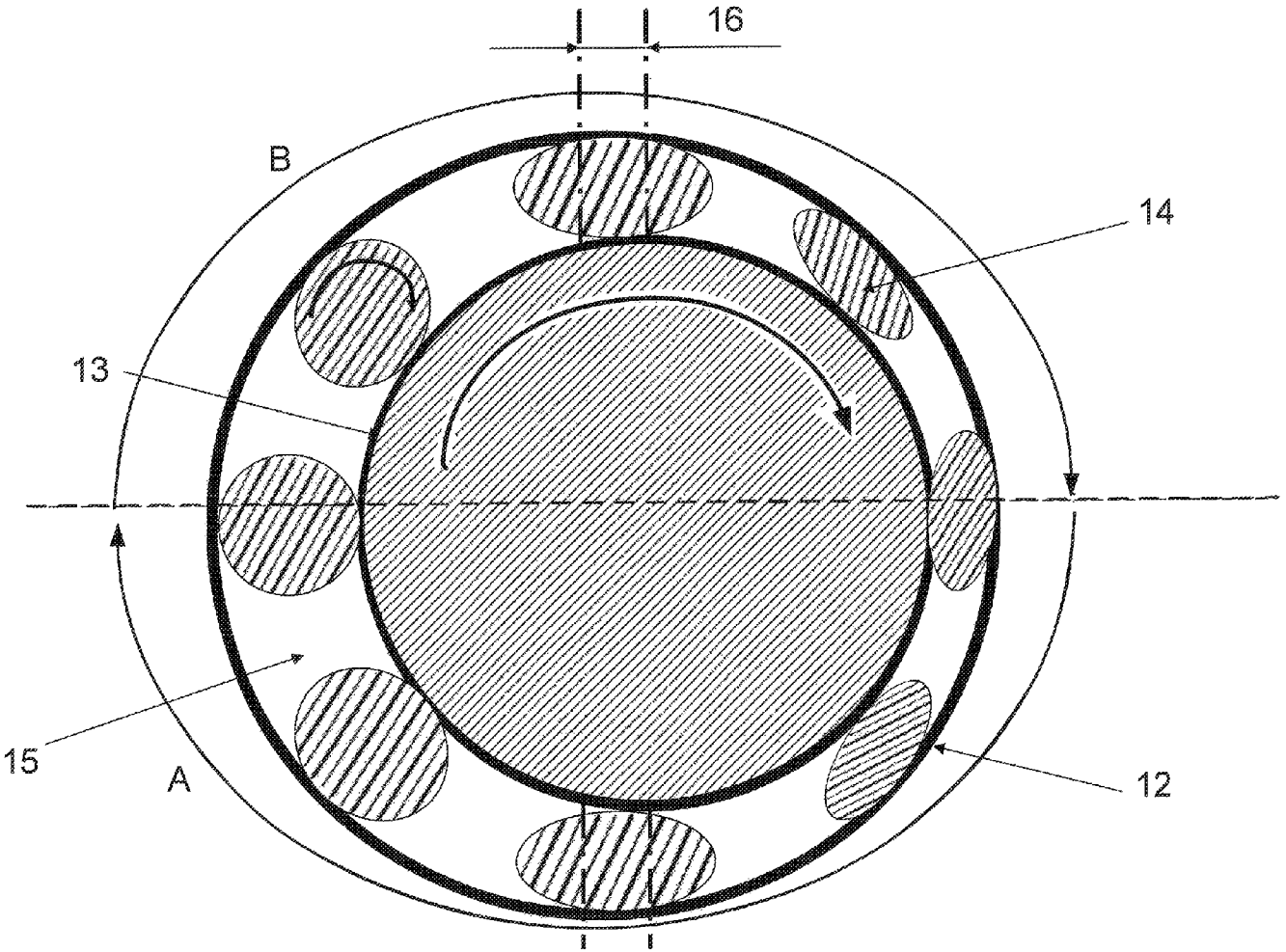
FIG. 5—cross-section of a positive-displacement rotary pump having deformable rollers according to another embodiment.

Pump 7 is a positive-displacement pump, one of whose versions is shown in FIG. 4. The pump shown in FIG. 4 includes hollow housing 12 wherein rotatable shaft 13 is positioned. In the variable-width working space defined between the shaft and housing, positioned are deformable rollers 14. Here, said variable width is provided by the elliptic cross-section of the housing and circular cross-section of the shaft. Each pair of contiguous rollers defines separate sealed cavity 15. As the rollers are deformed due to said variable width of the working space, the sealed cavities are able to grow or diminish in their volume. Each one of the sealed cavities, as its volume increases, communicates with the suction port, and as volume of a cavity decreases, that cavity communicates with the delivery port. Motor 8 has the similar design. Or such variable width can be provided by the off-centre positioning of the shaft with respect to the housing {FIG. 5). It should be noted that output of such pump as per turn of such pump can be varied by changing eccentricity 16 (FIG. 5) between the rotating shaft and housing. With the use of such adjustment, the constant rotational speed of the machine can be maintained, while speed of the flow will be adapted to a desired value by a change in eccentricity 16. Such adjustment can be effected by tuning of the downhole control system: in such case, the control system does not change the flow supplied to the motor, but alters a position of the pump shaft.

Figure 6:
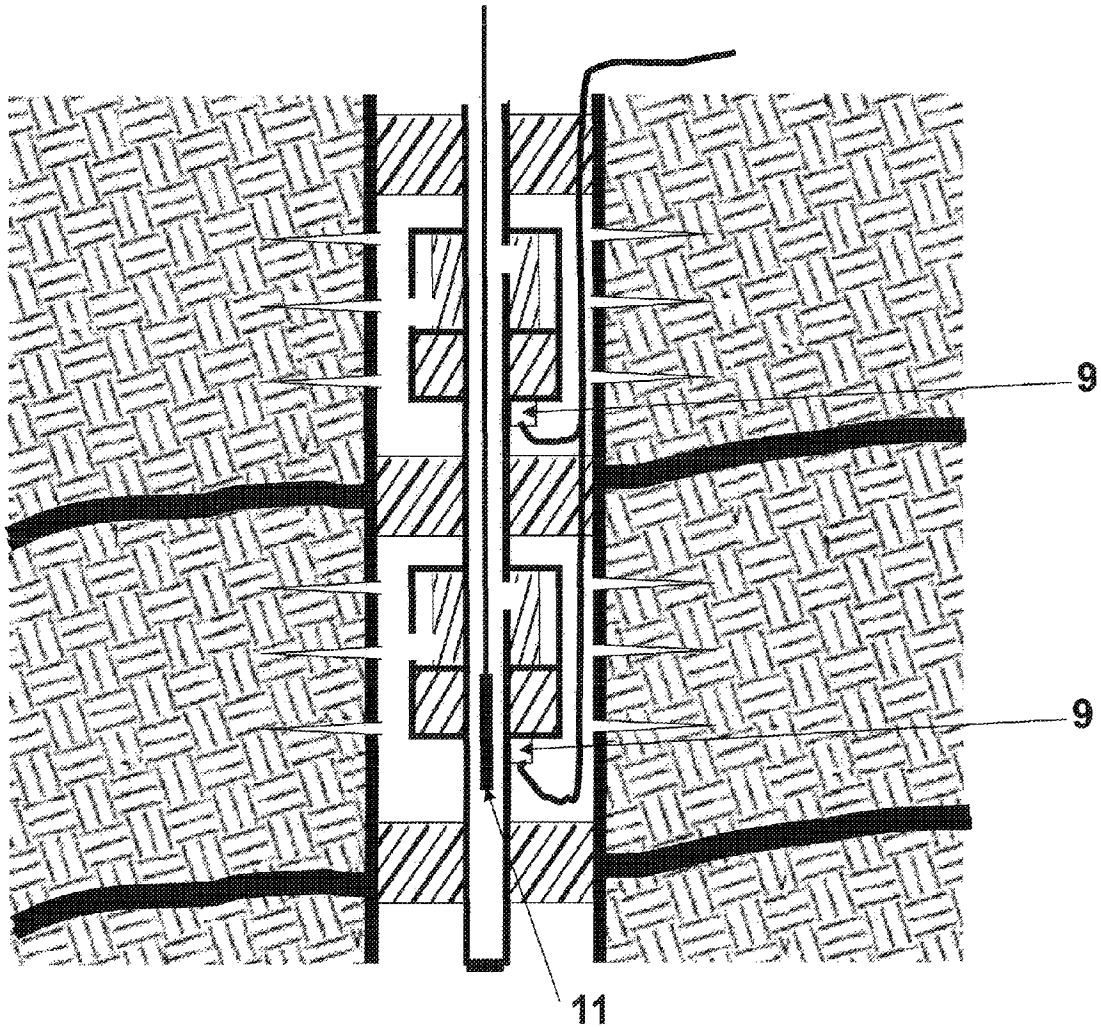
FIG. 6—adjustment of the pump control unit using a controlling tool that has been lowered into a well via a tubing and suspended on a cable.

Each control unit 9 ensures the independent control of the supply from a respective hydraulic machine. FIG. 6 shows possibility of tuning of lower unit 9 by a throttle that is adjustable using a wireline tool lowered along tubing 2. This tool 11 can be a mechanical adjusting tool, or a tool provided with internal electric controls. Other units 9 can be tuned similarly, or using other means. In particular, a unit can be adjusted using a pre-tuned throttle, or through changing of eccentricity of a machine, if used are the hydraulic machines having the shaft off-centred with respect to the housing, or by similar means.

Pump 7 is equipped with a sensor (hereinafter—a pump sensor) that concurrently provides the data on composition, speed and quantity of the extracted petroleum.

The claimed downhole system operates as follows: After the inventive downhole system has been installed within a well, the process of extraction of petroleum simultaneously out of a number of formations starts. At the initial stage, petroleum is extracted in the flowing well operation mode. Petroleum, subjected to the formation's natural pressure, is delivered into pump 7 through the suction port and, having passed therethrough, enters tubing 2. The petroleum, that passes through pump 7, causes this pump to drive motor 8, because pump 7 and motor 8 are mounted, according to this embodiment, on the single shaft. Motor 8 starts to operate in the pump mode, i.e. it performs suction of the degassed petroleum from the surface via the auxiliary line, and delivers the same into hydraulic line 10. Hydraulic line 10 has a throttle thereon, which throttle can be of the controlled or permanent types. As the degassed petroleum is throttled, motor 8 and, accordingly, pump 7 are braked. Owing to such adjustment, a predetermined productive capacity of a given formation is set. As the formation pressure falls, pressure of the petroleum delivered into pump 7 decreases. The necessity of additional driving of pump 7 is judged by a flow speed determined by the pump sensor. When such necessity is ascertained, the degassed petroleum into motor 8 is delivered via hydraulic line 10. Motor 8 drives pump 7 that begins suction of petroleum out of a producing formation, and delivers the same into tubing 2. For the reason that necessity of an additional drive of pump 7 in each producing formation differs, then a level of supply of the degassed petroleum from single hydraulic line 10 into each motor 8 is adjusted by control unit 9 of each motor 8. In FIG. 6, as one of embodiments of the invention, control unit 9 of the upper motor includes a throttle that is pre-adjusted to a predetermined value, and control unit 9 of lower motor 9 includes a controlled throttle that is adjusted using wireline tool 11. It should be obvious unto a person skilled in the art, that one given system may use both two versions of the throttles simultaneously, and only one of them.

A portion of the degassed petroleum supplied into motor 8, is sent to pump 7 for the purpose to fill said pump completely and eliminate formation of any clearance volumes in the pump, which volumes may be brought about by the phenomenon whereby from the petroleum released are bubbles of the gas dissolved in petroleum.

Though this description relates to a downhole system for petroleum extraction, nonetheless this downhole system can be also used for extraction of other fluids (liquids or gases). The downhole system needs no modification for extracting any other liquids or gases, because the claimed system, using the independently adjusted positive-displacement rotary pumps, is the versatile one.

The foregoing embodiments should not be regarded as any limitation of the scope of claims of this invention. A person skilled in the art will appreciate that in the above-discussed downhole system and, accordingly, in the immersion hydraulic machine many modifications are possible within the inventive principles as set forth in the accompanying claims of the invention.

The invention claimed is:

1. A downhole system for extracting fluids, comprising a casing pipe and a tubing extending through said casing pipe, between which pipe and tubing are formed separate isolated cavities, each cavity communicating, via perforations, with a respective producing formation;

in each one of the isolated cavities, a hydraulic machine is coupled to the tubing to achieve a common flow, the hydraulic machine comprising a hydraulic motor and pump;

the hydraulic machines being in different isolated cavities and being adapted to be adjusted independently of one another to achieve a flow of each extracted fluid at a respective flow rate from each corresponding isolated cavity into a common flow in the tubing;

wherein when an isolated cavity has a natural positive pressure to drive a flow of the extracted fluid through the pump of the hydraulic machine, the pump acts as a motor to drive the hydraulic motor as a passive pump, and the respective flow rate of the isolated cavity is achieved by constricting a flow of a working hydraulic fluid being pumped by the passive pump; and wherein when an isolated cavity has a natural negative pressure, the hydraulic motor adjustably drives the pump to provide artificial lift of the corresponding extracted fluid.

2. The system as claimed in claim 1, characterized in that said independent adjustment of the respective hydraulic machine is performed by a separate control unit adapted to adjust, supply to or output of the motor of the hydraulic machine.

3. The system as claimed in claim 2, characterized in that the control unit is adapted to adjust rotational speed of a hydraulic machine motor shaft, which motor is a hydraulic motor.

4. The system as claimed in claim 3, characterized in that the control unit includes an adjustable or permanent throttle positioned on the hydraulic line of said hydraulic motor.

5. The system as claimed in claim 2, characterized in that the control unit is adapted to adjust a value of eccentricity between the housing and shaft of a hydraulic machine motor, which motor is a hydraulic motor.

6. The system as claimed in claim 5, characterized in that the control unit includes an assembly of rod-hydraulic cylinder, a gearing assembly, or a similar means adapted to exert an action on a hydraulic motor shaft to change said eccentricity.

7. The system as claimed in claim 3 or 5, characterized in that the hydraulic motor is a positive-displacement rotary unit.

8. The system as claimed in claim 7, characterized in that the rotary positive-displacement unit is an impeller (guided-vane) pump, screw pump, labyrinth pump, or similar pump, or a modification thereof.

9. The system as claimed in claim 7, characterized in that the hydraulic motor is adapted to brake the pump in the mode of flowing well operation.

10. The system as claimed in claim 9, characterized in that said braking is done using a throttle positioned on the hydraulic motor supply line.

11. The system as claimed in claim 7, characterized in that the hydraulic motor is adapted to supply at least a portion of the working fluid into the pump.

12. The system as claimed in claim 2, characterized in that the supply for motor of each one of the hydraulic machines is provided by a single supply line.

13. The system as claimed in claim 2, characterized in that the supply for motor of each one of the hydraulic machines is provided by a separate supply line.

14. The system as claimed in claim 1, characterized in that the pump is implemented in the form of a rotary positive-displacement unit.

15. The system as claimed in claim 14, characterized in that the rotary positive displacement unit is an impeller (guided-vane) pump, screw pump, labyrinth pump, or similar pump, or a modification thereof.

16. The system as claimed in claim 1, characterized in that each one of the pumps is provided with a sensor adapted to determine speed and/or volume, and/or composition of the extracted fluid.

* * * * *